United States Patent [19]

Pessina et al.

[11] Patent Number: 4,747,592

[45] Date of Patent: May 31, 1988

[54] FEEDING MACHINE FOR SIGNATURES APPLICABLE TO MACHINES FOR FEEDING SHEETS FOR USE IN BINDING MACHINES, INC.

[76] Inventors: Giorgio Pessina; Aldo Perobelli, both of Via Timavo, 32 20037, Paderno Dugnano, Italy

[21] Appl. No.: 856,592

[22] Filed: Apr. 25, 1986

[30] Foreign Application Priority Data

May 5, 1985 [IT] Italy ..... 20566 A/85

[51] Int. Cl.[4] ..... B65H 5/02

[52] U.S. Cl. ..... 271/13; 271/31.1; 271/151; 271/161; 271/238; 271/240

[58] Field of Search ..... 271/151, 31.1, 10, 11, 271/12, 13, 161, 188, 200, 209, 237, 238, 240, 253–255

[56] References Cited

U.S. PATENT DOCUMENTS

| | | | |
|---|---|---|---|
| 2,729,136 | 1/1956 | Feick | 271/254 X |
| 3,357,700 | 12/1967 | Bradicich | 271/171 X |
| 3,674,258 | 7/1972 | Maier | 271/200 X |
| 3,904,191 | 9/1975 | Maier | 271/150 |
| 3,945,633 | 3/1976 | Knopp | 271/150 X |
| 4,015,843 | 4/1977 | Tennant | 271/237 X |
| 4,177,982 | 12/1979 | Bewersdorf | 271/151 X |
| 4,531,343 | 7/1985 | Wood | 271/151 X |
| 4,618,136 | 10/1986 | Pessina | 271/150 |

*Primary Examiner*—Richard A. Schacher
*Attorney, Agent, or Firm*—Bucknam and Archer

[57] ABSTRACT

A signature feeding machine which can be used on sheet feeders and the like utilized in book-binding, comprises a loading plane for supporting and conveying stacks of adjacently disposed signatures to an inclined signature elevator which transfers individual signatures to the level of a delivery plane on which the individual signatures are disposed substantially horizontally. Between the loading plane and the inclined elevator there is interposed an intermediate conveyor connection section pivoted at its end nearest the loading plane and provided with means for adjustment of its inclination.

3 Claims, 5 Drawing Sheets

FEEDING MACHINE FOR SIGNATURES APPLICABLE TO MACHINES FOR FEEDING SHEETS FOR USE IN BINDING MACHINES, INC.

BACKGROUND OF THE INVENTION

The present invention relates to a machine for feeding signatures and the like, which can be used in relation to sheet feeder machines and the like used in bookbinding.

As is known, in book-binding, there is currently the problem of delivering individual signatures to a working machine such as, for example, a sheet feeder, by withdrawing them individually from a stack of signatures which have been previously subjected to other types of operation.

Currently known machines for this purpose are generally constituted by a reciprocating plane onto which the stack of signatures is delivered and with which cooperate needle-like members adjustable in height with respect to the plane itself in such a way as to delimit an adequate transfer passageway in dependence on the thickness of the signatures themselves.

This type of machine is, however, constructionally complicated, above all because of the necessity of conferring reciprocating movement to the operating plane. Another disadvantage encountered with machines of this known type is constituted by the fact that it is not always possible to adjust the separation between the individually supplied signatures in dependence on the operating requirements of the machine, positioned downstream, to which the signatures are delivered.

In machines of known type there are also currently encountered significant difficulties if it is necessary to place the signatures at a working level positioned at a different height than that of the loading plane of the signature feeder.

OBJECTS OF THE INVENTION

A primary object of the present invention is that of eliminating the above indicated disadvantages by providing a signature feeding machine which is particularly designed for use with sheet feeders and the like, such as are utilised in book binding, which will be able to deliver the signatures individually at a required operating separation without by this having to require manual interventions of any type.

Another object of the invention is to provide a signature feeder machine which will be able to control the transport of individual signatures with high precision and certainty.

A further object of the invention is to provide a signature feeder machine which is able to control the advancement of the signatures which are loaded from time to time onto the machine in dependence on the speed at which the signatures are delivered by the machine.

Yet another object of the present invention is to provide a signature feeder machine which permits the signatures to be delivered from the machine at a different height from that at which they are loaded onto the machine, without constructional problems or difficulties.

Still another object of the invention is to provide a signature feeder machine which is structurally very simple and which is able to offer the widest guarantees of reliability and security in use.

SUMMARY OF THE INVENTION

According to the present invention, a machine for feeding signatures and the like to a sheet feeder machine for book binding, comprises means defining a loading plane for the support and conveyance of stacks of adjacently disposed signatures, an inclined signatures elevator, means defining a terminal delivery plane for delivery of individual signatures to a sheet feeder, an intermediate conveyor connector disposed between said loading plane means and said inclined signature elevator, said intermediate conveyor connector being pivotally mounted at the end thereof nearest said loading plane means, and inclination adjustment means on said intermediate conveyor connector for adjustment of the inclination thereof.

Further features and advantages of the invention will become more apparent from a study of the following description of a preferred embodiment thereof, in which reference is made to the accompanying drawings, and which is given purely by way of non-limitative example.

DESCRIPTION OF THE PREFERRED EMBODIMENT

Figure 1:
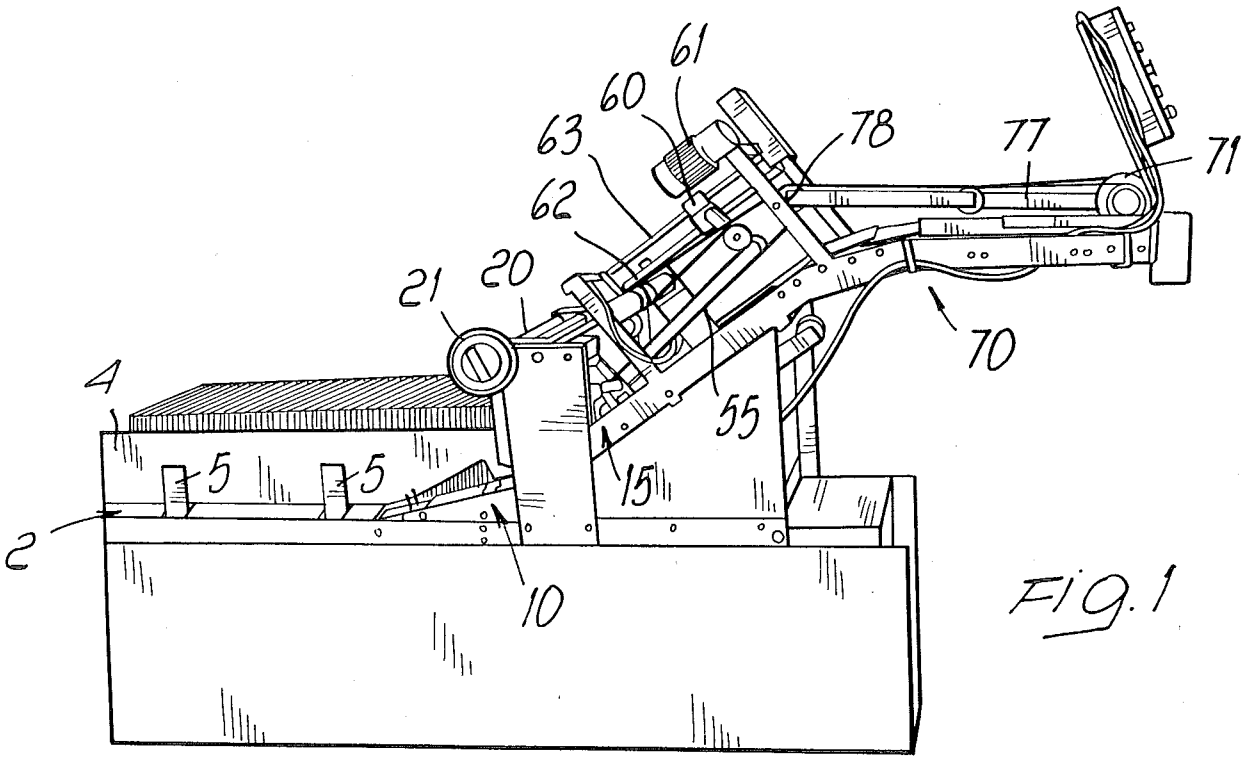
FIG. 1 is a schematic, perspective view of the machine according to the invention.
Figure 2:
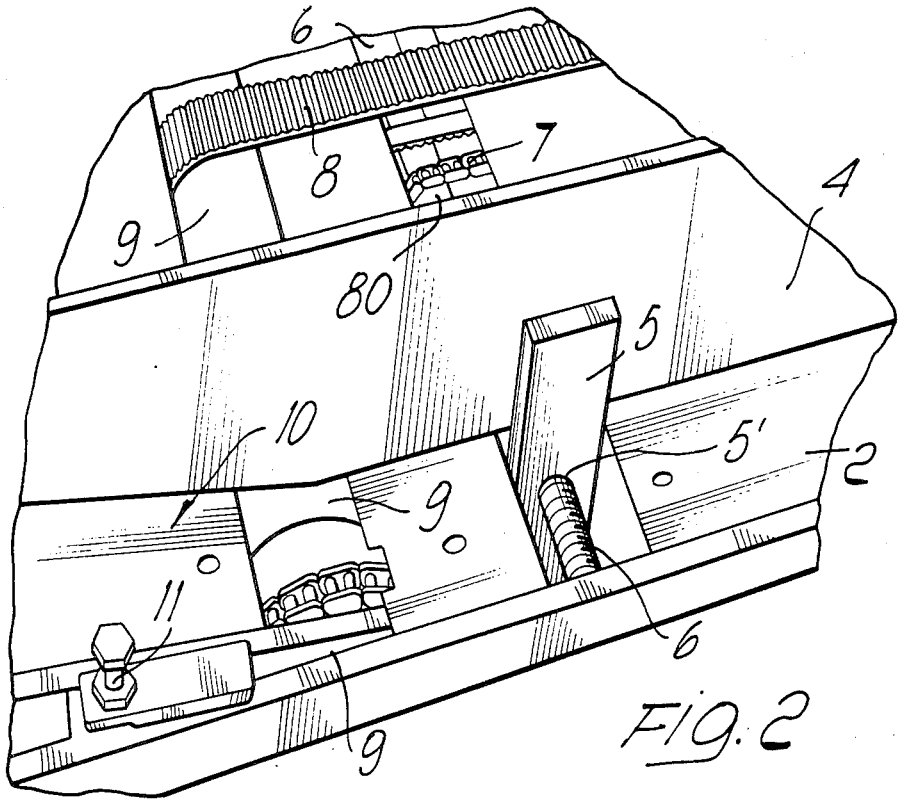
FIG. 2 is a detail of a portion of the loading plane and of the intermediate conveyor connector.
Figure 3:
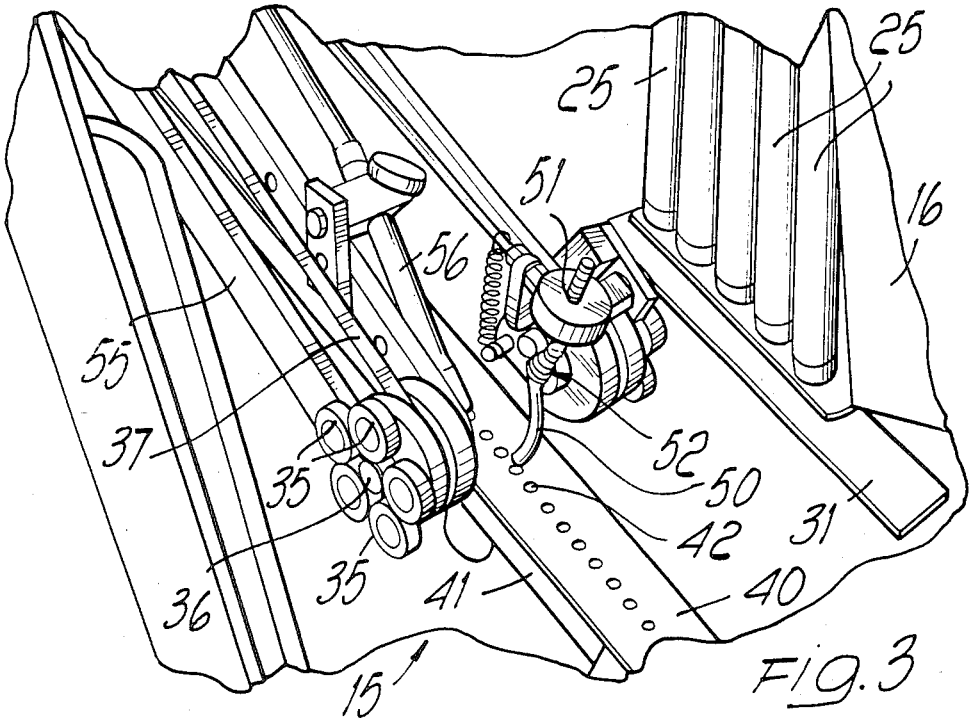
FIG. 3 is a perspective view of a detail of the feeler and advancement means of the inclined signature elevator.
Figure 4:
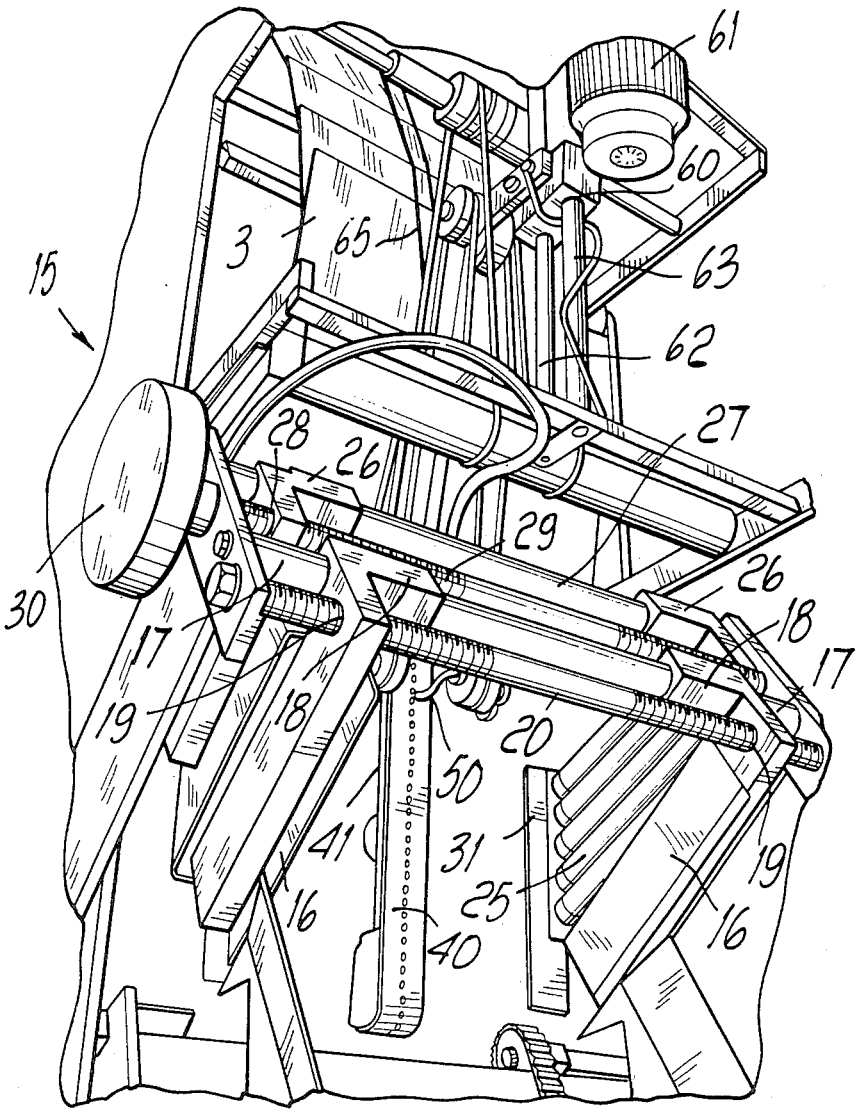
FIG. 4 is a perspective view of the inclined signature elevator showing the means for loading the signatures.
Figure 5:
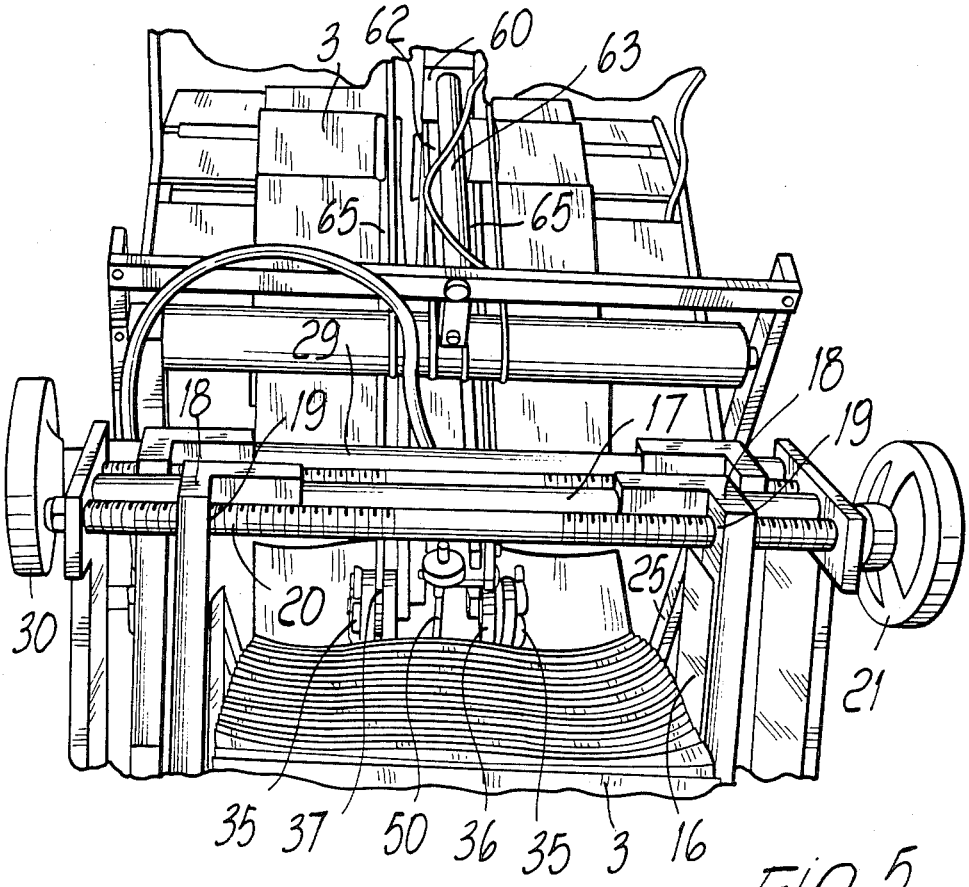
FIG. 5 is a front view of the signatures elevator showing loaded signatures in position thereon.
Figure 6:
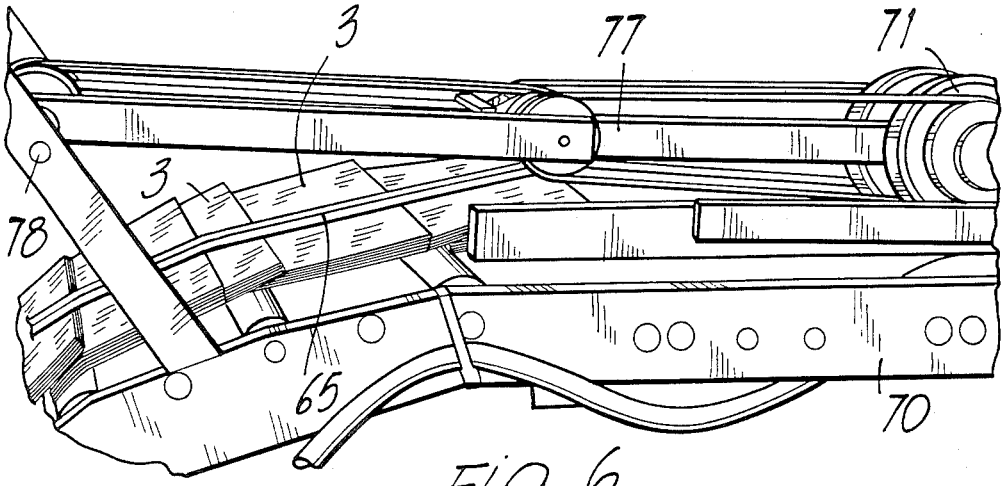
FIG. 6 is a side view illustrating a portion of the signature elevator where it joins the delivery plane of the machine.
Figure 7:
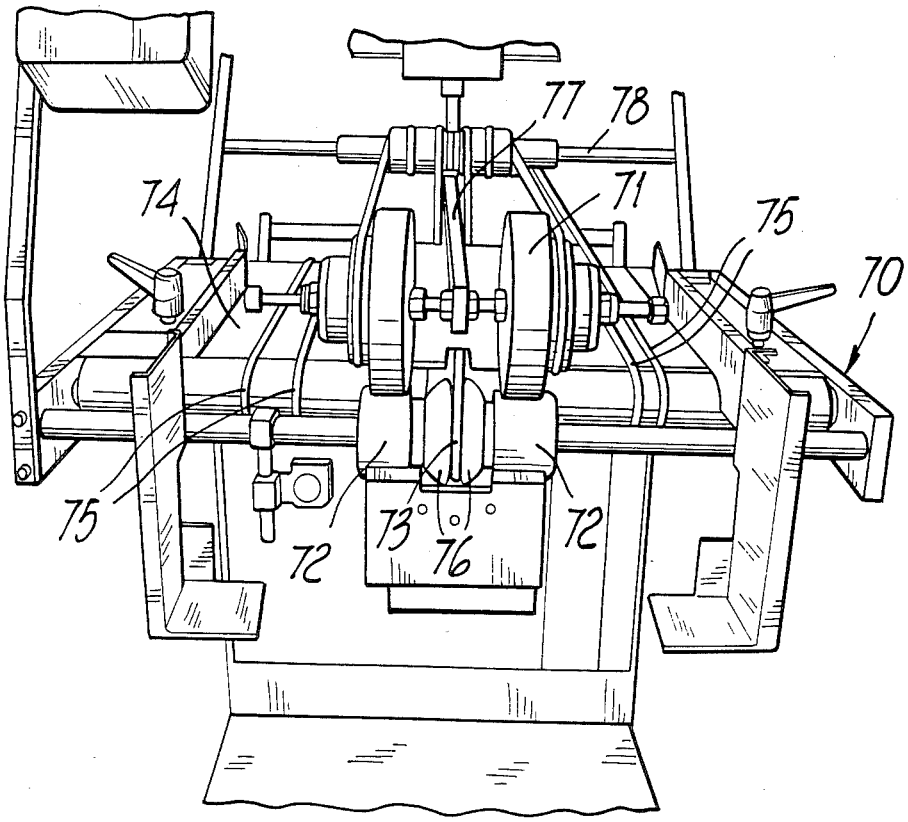
FIG. 7 is an end view of the delivery plane of the machine.

Referring now to the drawings, the signature feeder machine illustrated comprises a base generally indicated with the reference numeral 1, which has a loading plane 2 for the introduction of a stack of adjacently disposed signatures 3.

The loading plane 2 is provided with two upstanding longitudinally extending lateral side walls 4 supported by small brackets 5 projecting perpendicularly from the plane 2 and connected together by respective internally threaded sleeves 5' which engage with counter threaded screws generally indicated 6; these latter are made to turn by a motor—(not illustrated in the drawings)—which drives chains 7 which mesh with pinions 80 rigidly connected to the counter threaded screws 6 in such a way as to effect a symmetrical adjustment of the lateral separation between the side walls 4. Over the loading plane 2 extend belts 8 for causing an advancing movement of the signatures.

An important feature of the invention is constituted by the fact that, downstream of the loading plane 2, there is arranged an intermediate conveyor connector generally indicated with the reference numeral 10, which at its end nearest the loading plane 2 is pivoted about a roller 9 for driving the belt 8. The intermediate conveyor connector 10 is provided with micrometer screws 11 disposed on the sides thereof, which give the possibility of adjusting, with extreme precision, the inclination of the intermediate conveyor connector. Driving belts, not illustrated in the drawings, pass over the roller 9 and extend over the intermediate conveyor connector and which effect a reduction of the stacking pressure of the signatures which are positioned towards the upstream end of the loading plane. This stacking pressure reduction on the signatures consequently takes place before the signatures are introduced into the inclined signature elevator generally indicated with the reference numeral 15.

Downstream of the intermediate conveyor connector and close to the initial zone of the signature elevator 15, there are provided lateral adjustment devices which exert a pressure on the opposite lateral edges of the signatures being conveyed by the machine. Such lateral adjustment devices are constituted by a pair of vertical side walls 16 which converge towards the output end of the machine, and which are supported by a transverse guide bar 17 which functions as a sliding guide for a bracket 18, provided with a threaded seat 19, which engages with a first counter threaded rod 20 turnable by means of a first hand wheel 21. The adjustment of the first hand wheel 21 gives the possibility of effecting a simultaneous approach or separation of the inclined vertical side walls 16, consequently adjusting the mutual separation thereof.

Downstream of the lateral side walls 16 there are provided two symmetrical groups (with respect to the longitudinal extent of the machine) of inclined cylinders 25 which can turn about their axes and which are supported by a second bracket 26 slidable on a second guide bar 27 which is provided with a threaded seating 28 for engagement with a second rod 29 which also has a double counter thread and is turnable by a second hand wheel 30. The vertical side walls 16 serve to slightly brake the movement of the signatures as they arrive at the initial section of the inclined signature elevator whereby to reduce the pressure on the signatures downstream of the point, whilst the groups of inclined cylinders 25 serve to cause a double flexing of the introduced signatures, in cooperation with a central portion of the elevator, which projects above the bed of the machine. This causes the individual signatures to assume a double flexure with a central convexity facing upwardly and two intermediate lateral downwardly facing convex curves.

The cylinders 25 are supported from below by support strips which also have the function of supporting the lateral edge portions of the signatures in such a way as to allow these latter to assume the series of curvatures described hereinabove. The strips 31 can be displaced together with the groups of cylinders 25 upon adjustment of the second handwheel 30. In some cases, for example when signatures of great thickness are being fed by the signature feeder, it may be sufficient, and indeed appropriate, that the signatures should have a single central convexity without further downwardly facing convexities.

Adjacent the signature elevator there are provided devices for taking up individual signatures, which are constituted by a series of bearings 35 disposed in a star formation and mounted on a transverse shaft 36 which is put into rotation by means of the belts indicated 37. The bearings 35 have the function of flexing the signatures in such a way as to assume the curved conformation described hereinabove both in the case in which the signatures must assume an approximately sinusoidal conformation with an upwardly facing central convexity and two downwardly facing convexities on either side thereof, and the case in which the signatures must assume only a single curvature.

The said star-bearings 35 have the function of maintaining the signatures pressed against the central belt 40 which is driven by the control motor of the machine and which slides in a guide channel 41 which is maintained under suction. The central belt 40 is provided with a plurality of through holes 42 in such a way that the suction action present in the channel 41 causes the signatures to adhere to the central drive belt.

In the region of the working zone of the said star bearings there is provided a feeler 50 which can be contacted by the signatures and which is mounted in an oscillatable manner. The feeler device is contacted by the signatures when there are a relatively large number of these building up adjacent the feeler itself. In this circumstance the feeler 50 interrupts the advancement of the stack along the loading plane 2 until the number of signatures diminishes and the feeler is no longer stressed and can again allow the advancement of the signatures. For this operation the feeler closes a microswitch which supplies the control circuit of the drive members which effect advancement of the signatures along the loading plane of the machine.

The feeler 50 is adjustable in height by acting on a micrometer screw 51 cooperating with a biasing spring 52 which allows a raising and lowering of the feeler in such a way as to adjust the advancement of the signatures.

A first blower is positioned adjacent the intermediate conveyor connector, whilst in the vicinity of the star-rollers 35 there is positioned a second blower 56.

The star bearings 35 are supported by an arm 55 which is connected to a movable carriage 60 which is made to advance or retract by means of the use of a geared motor unit 61 which actuates a worm gear 62 which causes a translation of the carriage 60 movable on a longitudinal bar 63. The carriage 60 supports groups of pulleys over which pass belts which put the star bearings 35 into rotation, as well as pressure belts 65 which are held in contact with the signatures, as they are conveyed by the signature elevator of the machine. This movable carriage supports, as is already indicated, one of the blower elements 56, the star rollers 35 and the feeler element 50.

The particular construction of the movable carriage 60, with the associated return section of the belts 62 maintains constant the tension on the belts 62 themselves notwithstanding the advancement and retraction of the movable carriage. This is achieved because, upon elongation of a section of belt, there is in an equal and symmetrical manner a shortening of another section of belt. The signature elevator leads to a terminal or delivery section 70 which is disposed substantially horizontally and which is constituted by a plate-like element 74 along which the belts 75 slide, which belts deliver the individual signatures to the sheet feeder machines for subsequent conveyance.

At the delivery section 70 there is located a pair of upper output rollers 71 which contact a pair of lower rollers 72 driven to rotate by a belt 73 and provided with a median annular projecting portion 76 for causing a flexing of the signature at the moment of delivery to a sheet feeder machine which may be connected to the output of the above described signature feeder machine constituting the subject of the invention.

These upper output rollers 71 are supported by a central arm 77 turnable about transverse shafts 78. The flexing of the signatures upon delivery serves to make the signatures themselves more rigid and to prevent unwanted folding of the various signatures at the moment when these latter leave the signature feeder constituting the subject of the invention.

From what has been described hereinabove it will be seen how the invention achieves the proposed objects. In particular, it is emphasised that a signature feeding machine is provided which has an extremely simplified structure such as to allow an easy management of the machine without particular maintainance operations being required. The invention, thus conceived, is susceptible of numerous modifications and variations all lying within the scope of the inventive concept. Moreover, all the details can be replaced by other, technically equivalent, constructional details.

In practice, the materials used, as long as they are compatible with the specific use, as well as the dimensions and contingent forms can be of any suitable nature according to requirements without departing from the spirit and scope of the invention as defined in the appendant Claims.

What is claimed is:

1. A machine for feeding signatures to a sheet feeder machine for book binding, comprising means defining a loading plane for the support and conveyance of stacks of adjacently disposed signatures, an inclined signature elevator, means defining a delivery plane for the delivery of individual signatures to a sheet feeder, an intermediate conveyor connector disposed between said loading plane means and said inclined signature elevator, said intermediate conveyor connector being pivotally mounted at the end thereof nearest said loading plane means, inclination adjustment means on said intermediate conveyor connector for adjustment of the inclination thereof including micrometer screws supported on said intermediate conveyor connector and engageable on the frame of said feeder machine, said intermediate conveyor connector including drive belts against which said signatures on said loading plane means engage, said drive belts operating to reduce the pressure of the stack of signatures positioned upstream thereof on said loading plane means, wherein said machine further comprises signature stack pressure adjustment means located downstream of said loading plane means and including:

convergingly inclined vertical side walls, a first counter-threaded rod threadedly engaging said convergingly inclined vertical side walls, first means for rotating said first counter-threaded rod whereby to effect symmetrical adjustment of the lateral separation of said convergingly inclined vertical side walls, downstream of said convergingly inclined lateral side walls there being respective groups of rollers, one on each side, said rollers having inclined axes and being supported by support means threadedly engaged by a second counter-threaded rod, turnable by second rotating means, whereby to adjust separation of said groups of rollers, and wherein a feeler device is located between said groups of rollers for detecting the presence of an excess number of signatures on said loading plane means and operating to limit the advancement of the signatures on said loading plane means in dependence of said feeler device.

2. A signature feeding machine according to claim 1, wherein first blower means are positioned in the vicinity of said intermediate conveyor connector and second blower means are positioned in the vicinity of said feeler device.

3. A signature feeding machine according to claim 1, wherein in the vicinity of said intermediate conveyor connector there are provided signature take-off means including means for causing flexure of said signatures, said means including sets of bearings disposed in a star-shape configuration and supported by a shaft driven to rotate by a drive belt, said shaft being supported by arms connected to a movable carriage actuated via an endless screw by a geared motor unit.

* * * * *